US007186271B2

(12) United States Patent
Horikiri et al.

(10) Patent No.: US 7,186,271 B2
(45) Date of Patent: Mar. 6, 2007

(54) INFORMATION NOTIFYING METHOD AND APPARATUS

(75) Inventors: Kazunori Horikiri, Ashigarakami-gun (JP); Hitoshi Abe, Ashigarakami-gun (JP); Yusuke Kano, Ashigarakami-gun (JP); Hirotake Kudo, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 735 days.

(21) Appl. No.: 10/014,531

(22) Filed: Dec. 14, 2001

(65) Prior Publication Data

US 2003/0005332 A1 Jan. 2, 2003

(30) Foreign Application Priority Data

Jun. 29, 2001 (JP) ..... 2001-200066

(51) Int. Cl.

| | |
|---|---|
| ***G05F 1/26*** | (2006.01) |
| ***G05F 11/00*** | (2006.01) |
| ***G08B 13/00*** | (2006.01) |
| ***G08B 21/00*** | (2006.01) |
| ***G08B 29/00*** | (2006.01) |

(52) U.S. Cl. ..... 726/35; 709/223; 709/224; 348/143

(58) Field of Classification Search ..... 713/201; 348/143; 726/35; 709/223, 224
See application file for complete search history.

(56) References Cited

U.S. PATENT DOCUMENTS

| | | | | |
|---|---|---|---|---|
| 6,271,752 | B1 * | 8/2001 | Vaios | 340/541 |
| 6,476,858 | B1 * | 11/2002 | Ramirez Diaz et al. | 348/159 |
| 6,583,813 | B1 * | 6/2003 | Enright et al. | 348/150 |
| 6,657,553 | B1 * | 12/2003 | Bergman et al. | 340/870.11 |
| 6,681,120 | B1 * | 1/2004 | Kim | 455/556.1 |
| 6,697,103 | B1 * | 2/2004 | Fernandez et al. | 348/143 |
| 6,720,990 | B1 * | 4/2004 | Walker et al. | 348/143 |
| 6,829,478 | B1 * | 12/2004 | Layton et al. | 455/428 |

FOREIGN PATENT DOCUMENTS

| | | | |
|---|---|---|---|
| JP | 9-8925 | A | 1/1997 |
| JP | 10-40485 | A | 2/1998 |
| JP | 11-74977 | A | 3/1999 |
| JP | 11-177969 | A | 7/1999 |
| JP | 2000-341421 | A | 12/2000 |
| JP | 2001-76273 | A | 3/2001 |

* cited by examiner

*Primary Examiner*—Gilberto Barron
*Assistant Examiner*—Samson Lemma
(74) *Attorney, Agent, or Firm*—Oliff & Berridge PLC

(57) ABSTRACT

When a security server detects an abnormality in the building by a sensor, the security server sends an abnormality notification mail that has embedded a link to image information shot by a supervision camera upon detection of an abnormality and a mail address of the security server to a portable telephone terminal and in case neither access from the portable telephone terminal to the image information nor a response mail is confirmed, determines that the abnormality mail is not confirmed by the user and notifies occurrence of the abnormality to a security center.

32 Claims, 8 Drawing Sheets

INFORMATION NOTIFYING METHOD AND APPARATUS

BACKGROUND OF THE INVENTION

1. Field of the Invention

The present invention relates to an information notifying method and apparatus, and in particular to an information notifying method and apparatus that assures security by notifying a portable telephone terminal of information on the security of each home and the like.

2. Description of the Related Art

There has been provided a security system according to the related art, which sends information on an abnormality of a building to a portable telephone terminal of user via voice or picture in case that an abnormality has occurred in the building to notify the user of the abnormality in the building. Such a security system allows the user to recognize any abnormality that has taken place in the building even in case the user is out.

However, in the security system according to the related art, when the portable telephone terminal is powered off or the user has not recognized that the information on the abnormality has been sent to the portable telephone terminal, the user cannot cope with the abnormality that has occurred without delay.

SUMMARY OF THE INVENTION

The invention aims at providing an information notifying method and terminal that let the user or his/her proxy recognize an abnormality that has taken place in a building and take quick action.

To attain the aforementioned purpose, according to a first aspect of the invention, there is provided an information notifying method comprising the steps of:

supervising physical phenomenon of a predetermined supervision area;

when the physical phenomenon is detected by supervising, notifying detection information indicating that the physical phenomenon is detected to a first external apparatus;

determining whether user of the first external apparatus has accessed the notified detection information or not; and when it is determined that the user has not accessed the detection information, notifying the detection information to a second external apparatus.

According to a second aspect of the invention, there is provided the information notifying method according to the first aspect of the invention, wherein when it is determined at a time when a predetermined period has been elapsed from notifying the detection information to the first external apparatus that the user has not accessed the detection information, the detection information is notified to the second external apparatus.

According to a third aspect of the invention, there is provided the information notifying method according to the first aspect of the invention, wherein the detection information is notified to the first external apparatus a predetermined times; and when it is determined after the predetermined times of notification that the user has not accessed the detection information, the detection information is notified to the second external apparatus.

According to a fourth aspect of the invention, there is provided the information notifying method according to the first aspect of the invention, wherein when the detected physical phenomenon has a particular content, the detection information is notified to the second external apparatus without waiting for the determination that whether the user of the first external apparatus has accessed the notified detection information or not.

According to a fifth aspect of the invention, there is provided the information notifying method according to the first aspect of the invention, wherein the detection information notified to the first external apparatus is different from the detection information notified to the second external apparatus in content.

According to a sixth aspect of the invention, there is provided the information notifying method according to the fifth aspect of the invention, the detection information notified to the second external apparatus includes information whether the user has accessed the detection information notified to the first external apparatus.

According to a seventh aspect of the invention, there is provided the information notifying method according to the first aspect of the invention, further comprising the steps of:

receiving access completion information indicating that the user has accessed the detection information notified to the first external apparatus from the first external apparatus; and when the access completion information is received, determining that the user has accessed the detection information notified to the first external apparatus.

According to an eighth aspect of the invention, there is provided the information notifying method according to the seventh aspect of the invention, wherein the access completion information in an e-mail.

According to a ninth aspect of the invention, there is provided the information notifying method according to the first aspect of the invention, wherein the detection information notified to the first external apparatus includes at least one of still image and moving image of the detected physical phenomenon.

According to a tenth aspect of the invention, there is provided the information notifying method according to the first aspect of the invention, wherein the information notified to the second external apparatus is a non-image.

According to an eleventh aspect of the invention, there is provided the information notifying method according to the first aspect of the invention, wherein the step of notifying the detection information to the first external apparatus is preformed by using an e-mail.

According to a twelfth aspect of the invention, there is provided the information notifying method according to the first aspect of the invention, wherein the step of notifying the detection information to the first external apparatus is performed by using voice utilizing telephone lines.

According to a thirteenth aspect of the invention, there is provided the information notifying method according to the first aspect of the invention, wherein the step of notifying the detection information to the first external apparatus is preformed by using an e-mail; and when it is determined that the user has not accessed the detection information notified by using the e-mail, the step of notifying the detection information to the first external apparatus is performed by using voice utilizing telephone lines.

According to a fourteenth aspect of the invention, there is provided the information notifying method according to the first aspect of the invention, wherein the first external apparatus is a plurality of first external apparatuses;

the detection information is notified to each of first external apparatuses; and when it is determined that all of the users of the plurality of first external apparatuses have not accessed the detection information, the detection information is notified to the second external apparatus.

According to a fifteenth aspect of the invention, there is provided the information notifying method according to the fourteenth aspect of the invention, wherein the plurality of external units are portable terminals, respectively; and the step of notifying the detection information to the plurality of first external apparatuses is performed while giving priority to the portable telephone terminal closest to the supervision area based on location information of each of portable telephone terminals detected by using location detection function of each of portable telephone terminals.

According to a sixteenth aspect of the invention, there is provided the information notifying method according to the first aspect of the invention, further comprising the steps of notifying to the first external apparatus that the detection information has been notified to the second external apparatus.

According to a seventeenth aspect of the invention, there is provided the information notifying method according to the first aspect of the invention, wherein the detection information includes information used to grasp content of the physical phenomenon.

According to an eighteenth aspect of the invention, there is provided the information notifying method according to the first aspect of the invention, wherein the step of determining whether the user of the first external apparatus has accessed the notified detection information or not is performed on a basis of information indication that whether the first external apparatus is in a state where the first external apparatus can receive the detection information or not.

According to a nineteenth aspect of the invention, there is provided the information notifying method according to the first aspect of the invention, wherein the first external apparatus is a portable terminal.

According to a twentieth aspect of the invention, there is provided an information notifying method, supervising physical phenomenon in a predetermined supervision area;

when the physical phenomenon is detected by the supervising, notifying first detection information indicating the physical phenomenon is detected to first external apparatus; and notifying second detection information indicating that the physical phenomenon is detected to second external apparatus, wherein the first detection information is different from the second detection information in content.

According to a twenty-first aspect of the invention, there is provided an information notifying apparatus comprising:

a supervision unit adapted to supervise physical phenomenon in a predetermined supervision area;

a first notification unit adapted to notifying detection information indicating that the physical phenomenon has been detected to first external apparatus when the physical phenomenon has been detected by the supervision unit, a determination unit adapted to determine whether user of the first external apparatus has accessed the notified detection information, and a second notification unit adapted to notify the detection information when the determination unit determines that the user has not accessed the notified detection information.

According to a twenty-second aspect of the invention, there is provided the information notifying apparatus according to the twenty-first aspect of the invention, wherein when the determination unit determines that the user has not accessed the detection information at a time when a predetermined period has been elapsed from notifying the detection information to the first external apparatus, the second notification unit notifies the detection information to the second external apparatus.

According to a twenty-third aspect of the invention, there is provided the information notifying apparatus according to the twenty-first aspect of the invention, wherein the first notification unit notifies detection information to the first external apparatus a predetermined number of times; and when the determination unit determines after the predetermined times of notification that the user has not accessed the detection information, the second notification unit notifies the detection information to the second external apparatus.

According to a twenty-fourth aspect of the invention, there is provided the information notifying apparatus according to the twenty-first aspect of the invention, wherein when the detected physical phenomenon has a particular content, the second notification unit notifies the detection information to the second external apparatus without waiting that the determination unit determinates whether the user of the first external apparatus has accessed the notified detection information or not.

According to a twenty-fifth aspect of the invention, there is provided the information notifying apparatus according to the twenty-first aspect of the invention, wherein the detection information notified to the first external apparatus is different from the detection information notified to the second external apparatus in content.

According to a twenty-sixth aspect of the invention, there is provided the information notifying apparatus according to the twenty-fifth aspect of the invention, wherein the second notification unit notifies to the second external apparatus the detection information including information whether the user has accessed the detection information notified to the first external apparatus.

According to a twenty-seventh aspect of the invention, there is provided the information notifying apparatus according to the twenty-first aspect of the invention, wherein the determination unit receives access completion information indicating that the user has accessed the detection information notified to the first external apparatus from the first external apparatus; and when the determination unit receives the access completion information, the determination unit determines that the user has accessed the detection information notified to the first external apparatus.

According to a twenty-eighth aspect of the invention, there is provided the information notifying apparatus according to the twenty-seventh aspect of the invention, wherein the access completion information in an e-mail.

According to a twenty-ninth aspect of the invention, there is provided the information notifying apparatus according to the twenty-first aspect of the invention, wherein the detection information notified to the first external apparatus includes at least one of still image and moving image of the detected physical phenomenon.

According to a thirtieth aspect of the invention, there is provided the information notifying apparatus according to the twenty-first aspect of the invention, wherein the information notified to the second external apparatus is a non-image.

According to a thirty-first aspect of the invention, there is provided the information notifying apparatus according to the twenty-first aspect of the invention, wherein the first notification unit notifies the detection information to the first external apparatus by using an e-mail.

According to a thirty-second aspect of the invention, there is provided the information notifying apparatus according to the twenty-first aspect of the invention, wherein the first notification unit notifies the detection information to the first external apparatus by using voice utilizing telephone lines.

According to a thirty-third aspect of the invention, there is provided the information notifying apparatus according to the twenty-first aspect of the invention, wherein the first notification unit notifies the detection information to the first external apparatus by using an e-mail; and when the determination unit determines that the user has not accessed the detection information notified by using the e-mail, the first notification unit notifies the detection information to the first external apparatus by using voice utilizing telephone lines.

According to a thirty-fourth aspect of the invention, there is provided the information notifying apparatus according to the twenty-first aspect of the invention, wherein the first external apparatus is a plurality of first external apparatuses;

the first notification unit notifies the detection information to each of first external apparatuses; and when the determination unit determines that all of the users of the plurality of first external apparatuses have not accessed the detection information, the second notification unit notifies the detection information to the second external apparatus.

According to a thirty-fifth aspect of the invention, there is provided the information notifying apparatus according to the thirty-fourth aspect of the invention, wherein the plurality of external units are portable terminals, respectively; and the first notification unit notifies the detection information to the plurality of first external apparatuses while giving priority to the portable telephone terminal closest to the supervision area based on location information of each of portable telephone terminals detected by using location detection function of each of portable telephone terminals.

According to a thirty-sixth aspect of the invention, there is provided the information notifying apparatus according to the twenty-first aspect of the invention, wherein the first notification unit notifies information indicating that the detection information has been notified to the second external apparatus to the first external apparatus.

According to a thirty-seventh aspect of the invention, there is provided the information notifying apparatus according to the twenty-first aspect of the invention, wherein the detection information includes information used to grasp content of the physical phenomenon.

According to a thirty-eighth aspect of the invention, there is provided the information notifying apparatus according to the twenty-first aspect of the invention, the determination unit determines whether the user of the first external apparatus has accessed the notified detection information or not on a basis of information indication that whether the first external apparatus is in a state where the first external apparatus can receive the detection information or not.

According to a thirty-ninth aspect of the invention, there is provided the information notifying apparatus according to the twenty-first aspect of the invention, wherein the first external apparatus is a portable terminal.

According to a fortieth aspect of the invention, there is provided an information notifying apparatus comprising;

a supervision unit adapted to supervise physical phenomenon in a predetermined supervision area;

a first notification unit adapted to notify first detection information indicating the physical phenomenon is detected to first external apparatus, when the physical phenomenon is detected by the supervision unit; and a second notification unit adapted to notify second detection information indicating that the physical phenomenon is detected to second external apparatus, wherein the first detection information is different from the second detection information in content.

DETAILED DESCRIPTION OF THE PREFERRED EMBODIMENTS

There will be given on embodiments of an information notifying method and apparatus according to the invention with reference to the attached drawings.

Figure 1:
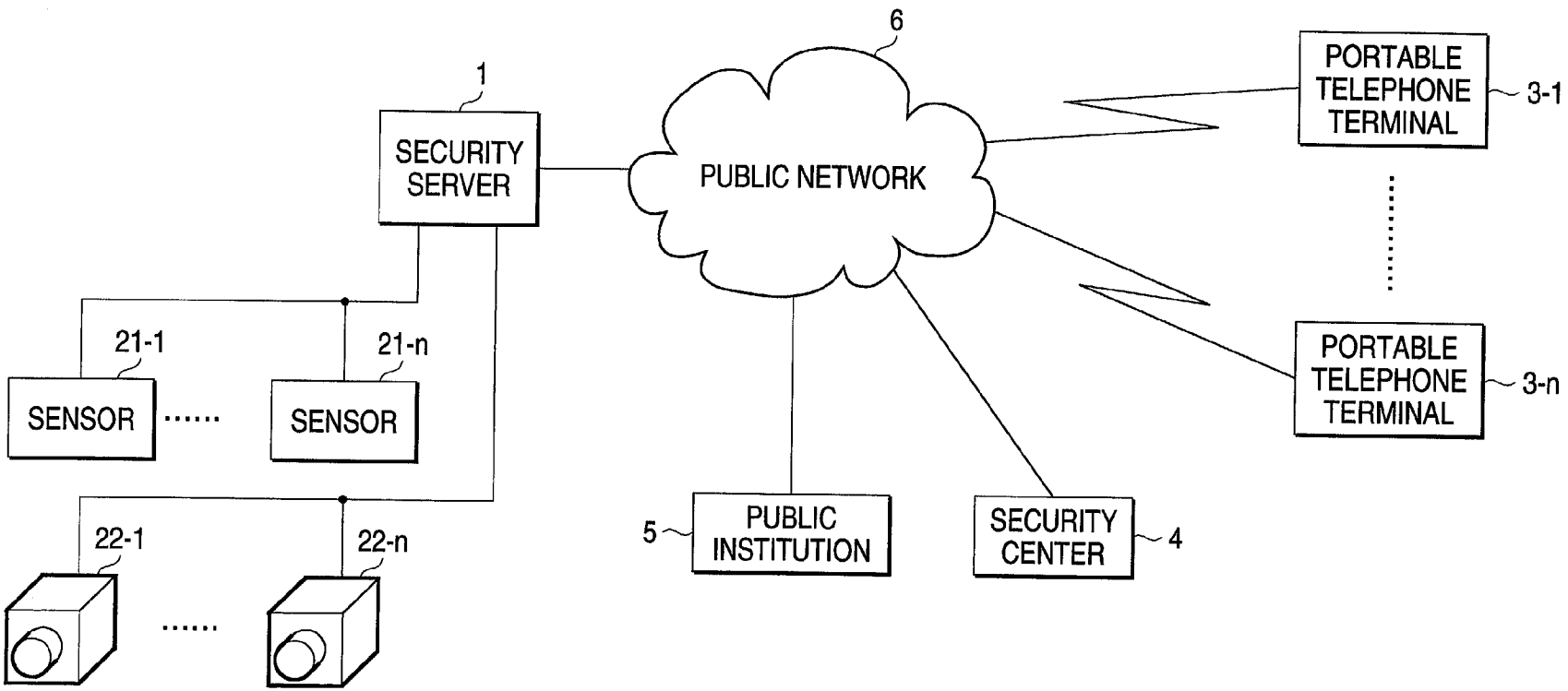
FIG. 1 shows an example of a security system configured by applying an information notifying method and apparatus according to the invention thereto.

FIG. 1 is a system configuration diagram showing an example of an information notifying system according to the invention.

In FIG. 1, an information notifying system according to this embodiment in configured by interconnecting a security server 1, portable telephone terminals 3 (3-1 through 3-n), security center 4, and public institutions 5 such as a police station, a fire station, and the like via a public network 6 including a public telephone network, a radio communications network, the internet, and the like. Various sensors 21 (21-1 through 21-l) and supervision cameras (22-1 through 22-m) are installed inside and outside of buildings under supervision and connected to the security server 1.

The security server 1 is installed inside (or outside) a building under supervision and records images shot by the supervision camera 22. The security server 1 creates an abnormality notification mail carrying a warning message depending on a warning signal output from the sensor 21, embeds a link to still pictures or moving pictures shot by the supervision camera 22 upon occurrence of an abnormality, and sends the resulting mail to the portable telephone terminal 3 and the security center 4. The security server 1 can also send still pictures or moving pictures shot by the supervision camera 22 upon occurrence of an abnormality as attached files together with the abnormality notification mail.

The sensors 21 (21-1 through 21-l) includes smoke sensors and/or gas sensors, which detect a fire accident and/or gas leakage, door sensors or infrared sensors, which detect an intruder, detects an abnormality, and outputs a warning signal. Required types and number of sensors 21 can be installed arbitrarily depending on purpose.

The supervision cameras (22-1 through 22-m) includes digital cameras and/or video cameras and shoots the inside of the room in order to supervise the presence/absence of an abnormality in the room. Required types and number of supervision cameras 22 can be installed arbitrarily depending on the purpose.

The sensors 21 and supervision cameras 22 are installed at least by one-to-one correspondence. The sensors and supervision cameras are installed so that an abnormality detected by the sensors 21 is shot by the supervision cameras 22. For example, a single supervision camera may correspond to a plurality of sensors installed in close proximity. A plurality of supervision cameras may correspond to a single sensor so that an abnormality can be shot from various viewpoints in a diversified way.

The portable telephone terminals (31 through 3-n) are general portable telephone terminals owned by owner, resident or caretaker of the building under supervision. The telephone numbers of the portable telephone terminals are registered with the security server 1 in advance. In relation to portable telephone terminals having peculiar mail addresses and being capable of receiving the abnormal notification from the security server 1, the mail addresses registered with the security server 1 in advance.

The security center 4 is an institution, which accepts an abnormality notification from the security server 1 and may be a specialist security company or a voluntary organization in units of self-governing bodies, or public organization in units of municipalities, which accepts crime prevention and fire prevention notification, that is, a public organization such as a police station, fire station and a hospital.

Figure 2:
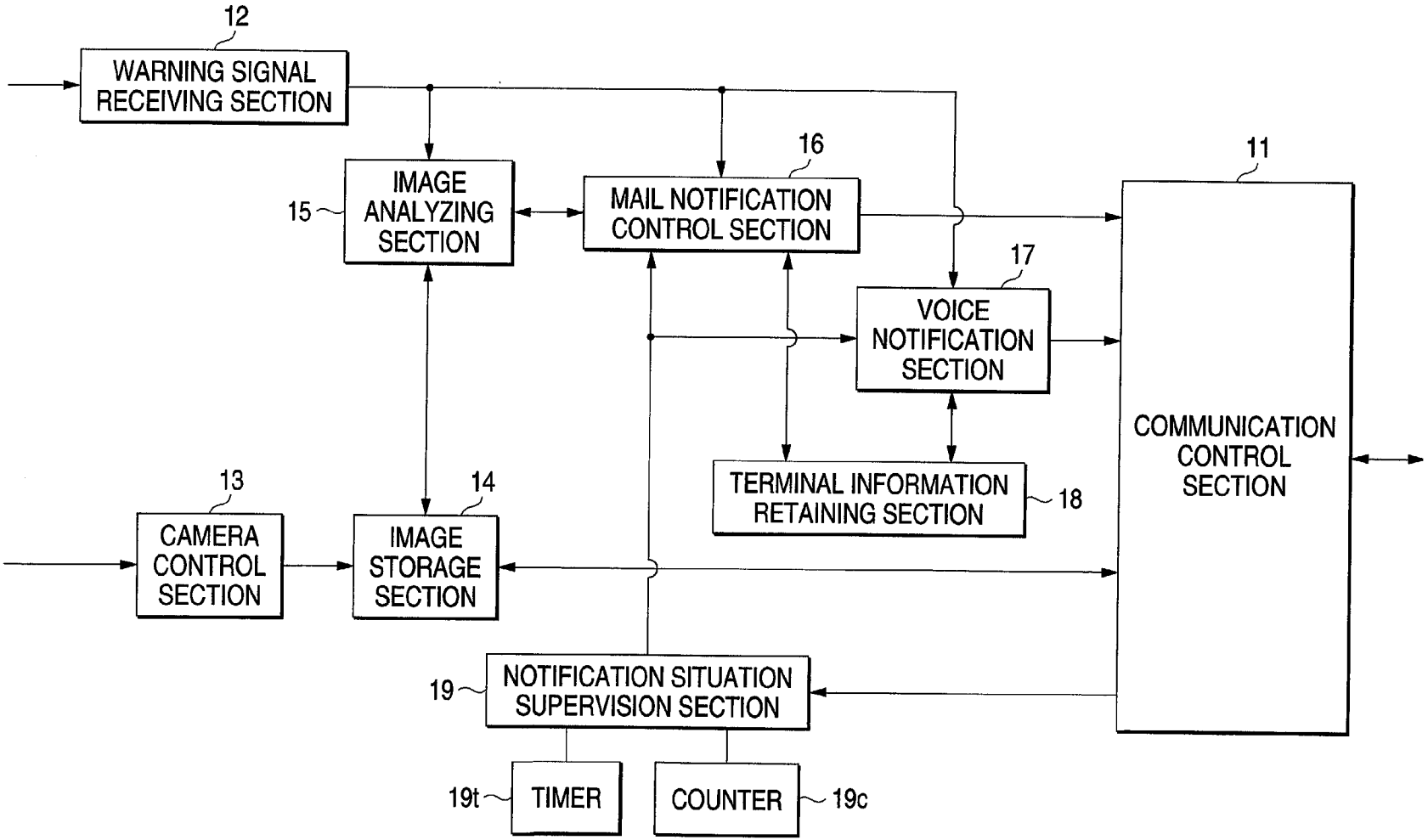
FIG. 2 is a block diagram showing a detailed configuration of main sections of a security server 1 shown in FIG. 1.

FIG. 2 is a block diagram showing an example of a configuration of the security server 1.

In FIG. 2, the security server 1 comprises at least a communication control section 11, a warning signal receiving section 12, a camera control section 13, an image storage section 14, an image analyzing section 15, a mail notification control section 16, a voice notification control section 17, a terminal information retaining section 18, and a notification situation supervision section 19.

The camera control section 23 performs control of the supervision camera 22 such as changing the shooting area and zooming as well as records the image information shot by the supervision camera 22 in the image storage section 14.

The warning signal receiving section 12 receives a warning signal from the sensor 21, detects place where an abnormality has occurred based on installation location of the sensor 21, which is a source of the received warning signal, and notifies information on the detected place to the image analyzing section 15, the mail notification control section 16, and the voice notification control section 17. The warning signal receiving section 12 may roughly identify contents of the abnormality that has taken place in accordance with the type of the sensor 21 as a source of the received warning signal. For example, in case that the sensor 21 as a source of the warning signal is a gas sensor, the abnormality that has occurred can be identified as "gas leakage."

When the occurrence of the abnormality and the place where the abnormality occurs is notified from the warning signal receiving section 12 to the image analyzing section 15, the notification of an abnormality and the place of abnormality occurred by the warning signal receiving section 12, the image analyzing section 15 appends an identifier to the image information shot by the supervision camera 22 and recorded in the image storage section 14. Then the image analyzing section 15 notifies the identifier to the mail notification control section 16.

Figure 6:
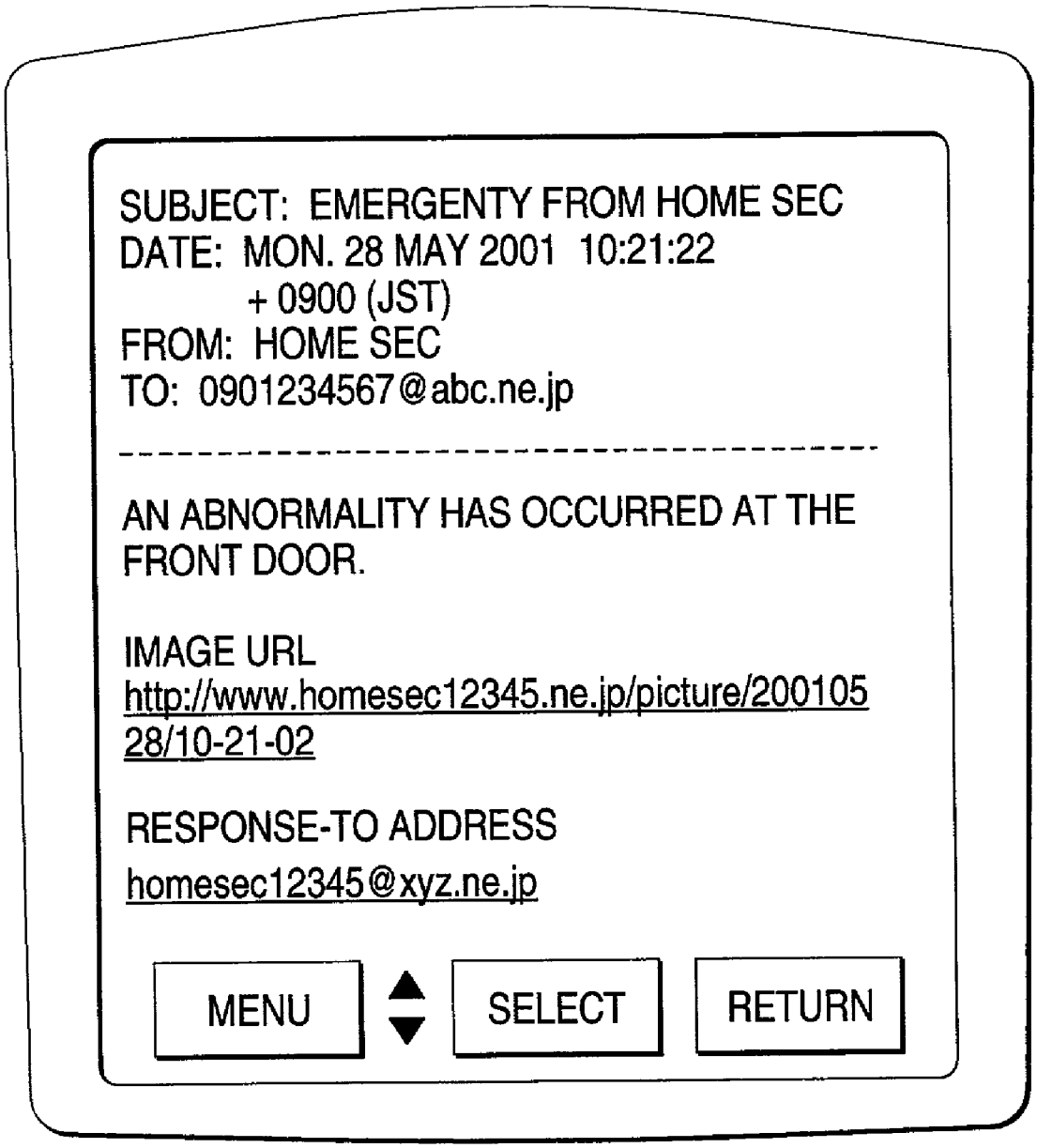
FIG. 6 shows an example of an abnormality notification mail sent by the security server 1 to a portable telephone terminal 3.

The mail notification control section 16 creates an abnormality notification mail described occurrence of an abnormality and the place where the abnormality occurs in the message body and creates reference information (such as URL) to image information that indicates the abnormality and embeds the reference information in the mail body as well as embeds the mail address of the security server 1 in the mail body, and then sets the address registered with the terminal information retaining section 18 as a destination to send the abnormality information mail to the public network such as the internet and the like via the communication control section 11. An example of an abnormality notification mail created by the mail notification control section 16 is shown in FIG. 6.

The voice notification control section 17 creates voice information (hereinafter referred to as an abnormality notification announcement), which notifies occurrence of an abnormality and the place of abnormality, and calls the telephone number registered with the terminal information retaining section 18 via the communication control section 11 to send the abnormality notification announcement. The abnormality notification announcement is created by selecting for example pre-registered voice information. For example, proper voice information such as "An abnormality has occurred at the front door," or "A gas leakage is detected in the kitchen." is registered per sensor 21. The voice notification control section 17 selects the voice information in correspondence with the sensor 21, which is a source of the received warning signal to determine the abnormal notification announcement.

The terminal information retaining section 18 stores and retains the telephone number and the mail address of the portable telephone terminal 3 owned by the user and the telephone number and the mail address of the security center 4. The telephone number and the mail address of the portable telephone terminal 3 are registered by the user in advance. A plurality of telephone numbers and the mail addresses of the portable telephone terminal 3 can be registered. Thus, by registering for example the telephone numbers and mail addresses of all the family members, it is possible to notify the occurrence of an abnormality more securely. It is also possible to register only the telephone number of a portable telephone terminal without a mail address and only the mail address of a network terminal without the telephone function.

The image storage section 14 stores and retains the image information sent from the supervision camera 22 as well as converts the image information to the streaming video format, animation GIF, or JPEG in response to a request from the portable telephone terminal 3 and incorporates the converted image information into HTML to provide the image information as an HTML file (or equivalent data file). The image information provided is a still image obtained when an abnormality occurred in the supervision area or a moving image recorded since the abnormality occurred. In response to a request from the portable telephone terminal 3, the current still image or moving image may be provided as well.

The notification situation supervision section 19 is a component characteristic of the security server 1. The notification situation supervision section 19 has a timer 19*t* and a counter 19*c* and determines whether the user has confirmed the abnormality notification mail issued from the security server 1. Determination on whether the user has confirmed the abnormality notification mail is made by determining whether the image storage section 14 has been accessed by the portable telephone terminal 3 or an response mail was received from the portable telephone terminal 3. The response mail to the security server 3 may be an idle mail (mail without the message body).

Figure 3:
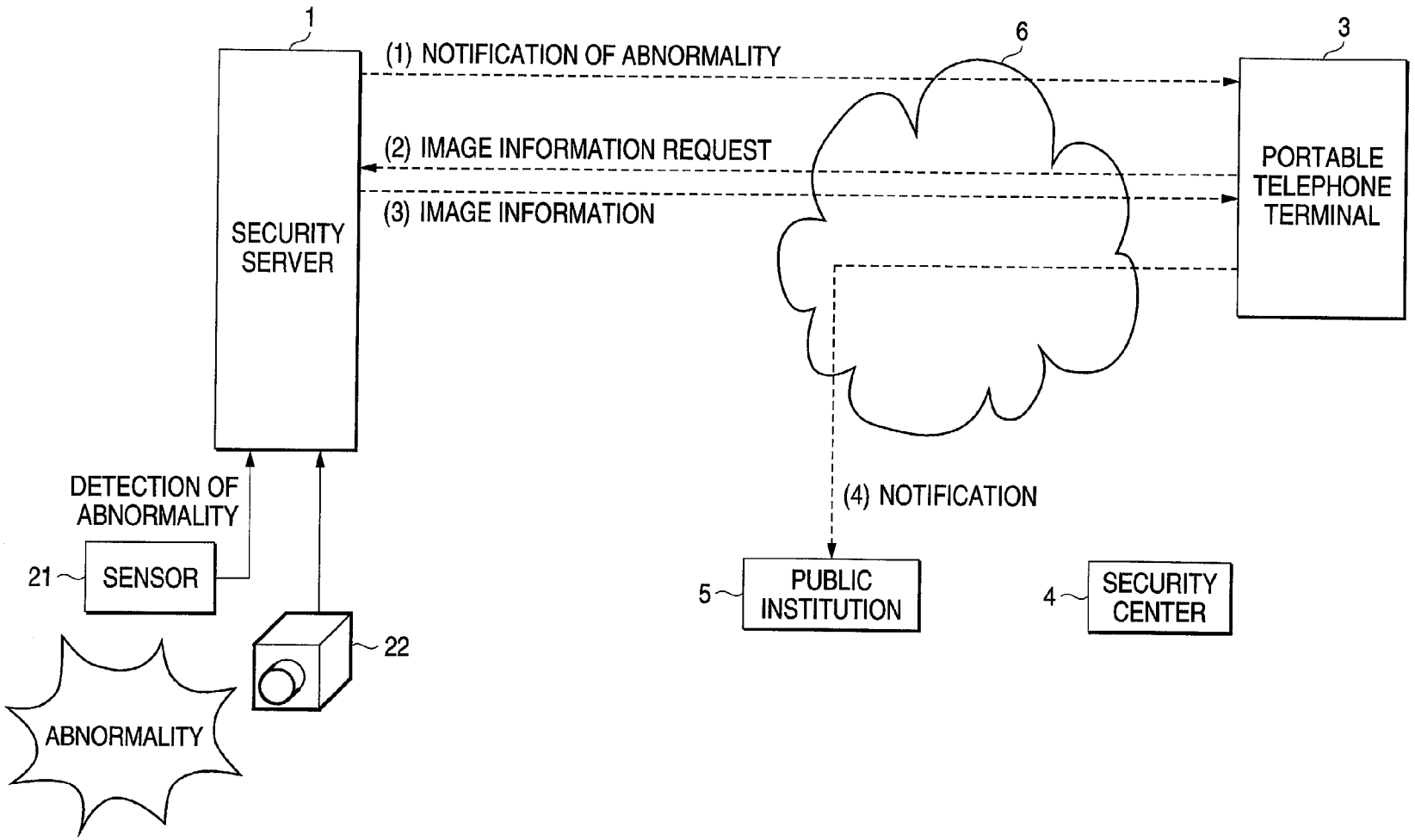
FIG. 3 shows an example of an information notifying method in the security system shown in FIG. 1.

FIG. 3 shows an example of information notification processing in the information notifying system shown in FIG. 1.

In FIG. 3, when the security server 1 receives a warning signal from the sensor 21, the security server 1 sends an abnormality notification mail that has embedded a link (URL) to the image shot by the supervision camera 22 upon occurrence of an abnormality and recorded in the image storage section 14 and the mail address of the security server to the portable telephone terminal 3 as well as starts time keeping by the timer 19*t* in the notification situation supervision section 19 and count of notification mail sending times by the counter 19*c*.

The user confirms at the portable telephone terminal 3 the abnormality notification mail from the security server 1. If the user wishes to confirm the image at a time when the abnormality occurred, the user accesses the image information on the image storage section 14 from the URL embedded in the abnormality notification mail. In case that the user determines it is not necessary to confirm the image, the user responses to the mail address of the security server 1 embedded in the abnormality notification mail. Then the user notifies the occurrence of an abnormality to the public institution 5, depending on the situation.

A response selection screen including a police notification button, a fire station notification button, a security center notification button, and a neglect (not responding) button is displayed on a LCD screen of the portable telephone terminal 3. The user of the portable telephone terminal 3 confirms the screen and then, selects one of the buttons for determination. In case that the police notification button is selected, the information is sent to the police station. In case that the fire station notification button is pressed, the information is sent to the fire station. The information is sent to the security center 4 or the security server 1 when the security center notification button or the Neglect button is pressed, respectively.

When the security server 1 confirms the access from the portable telephone terminal 3 to the image storage section 14 or the reception of a response mail, the security server 1 finishes time keeping by the timer 19*t* and the count by the counter 19*c*.

Figure 4:
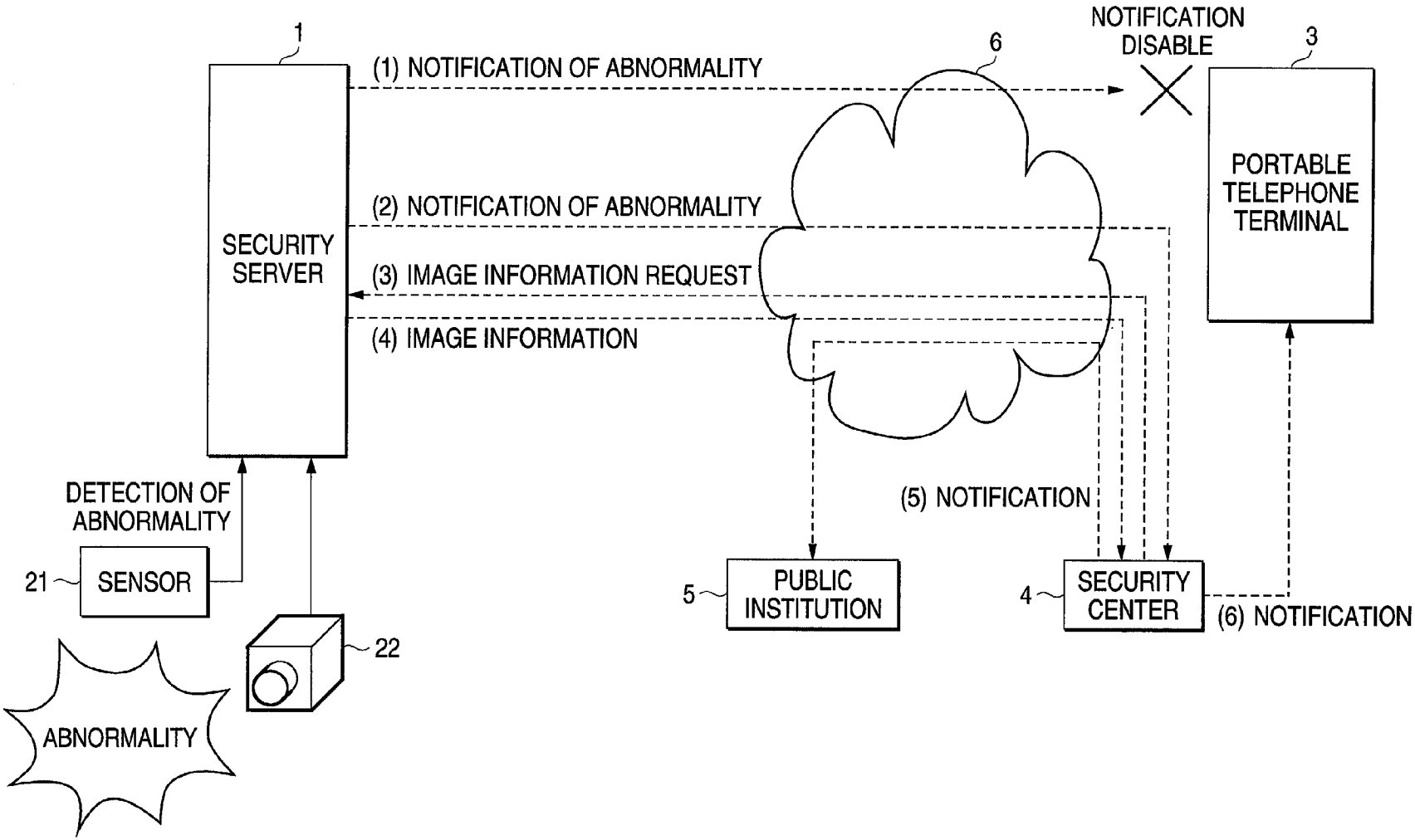
FIG. 4 shows an example of an information notifying method in the security system shown in FIG. 1.

FIG. 4 shows an example of information notification processing in case that the user has failed to confirm the abnormality notification mail from the security server 1.

In FIG. 4, when the security server 1 receives a warning signal from the sensor 21, the security server 1 sends an abnormality notification mail that has embedded a link to the image shot by the supervision camera 22 upon occurrence of an abnormality and recorded in the image storage section 14 and the mail address of the security server to the portable telephone terminal 3 and starts time keeping by the timer 19*t* in the notification situation supervision section 19 and the count of notification mail sending times by the counter 19*c*.

When an access from the portable telephone terminal 3 to the image storage section 14 or reception of a response mail is not confirmed after a predetermined time has elapsed, the security server 1 increments the counter 19*c* by one and instructs the mail notification control section 16 to resend the abnormality notification mail.

When an access from the portable telephone terminal 3 to the image storage section 14 or reception of a response mail is not confirmed in spite of resending the abnormality notification mail a predetermined number of times, the security server 1 sends the abnormality mail to the security center 4.

The security center 4 confirms the abnormality mail sent from the security server 1. If wishing to confirm the image at a time when the abnormality occurred, the security center 4 accesses the image information on the image storage section from the URL embedded in the abnormality notification mail and then notifies to the public institution 5, depending on the situation. The security center 4 notifies the portable telephone terminal 3 that the abnormal notification mail has been received.

The fact that the abnormality notification mail has been sent to the security center 4 may be notified from the security server 1 to the portable telephone terminal 3.

The image information, which can be confirmed by the security center 4 on the security server 1, may be restricted. For example, the security server 1 determines who requested access to the image storage section 14. In case that the request is made by the security center 4, the security center inhibits an access to a predetermined image. Whereby the image information, which the user wishes to hide, is prevented from being accessed by others in the security center 4.

In case that the abnormality that occurred is a specific event such as a fire and gas leakage, abnormality information is preferably notified to the portable telephone terminal 3 and the security center 4 at the same time.

Figure 5:
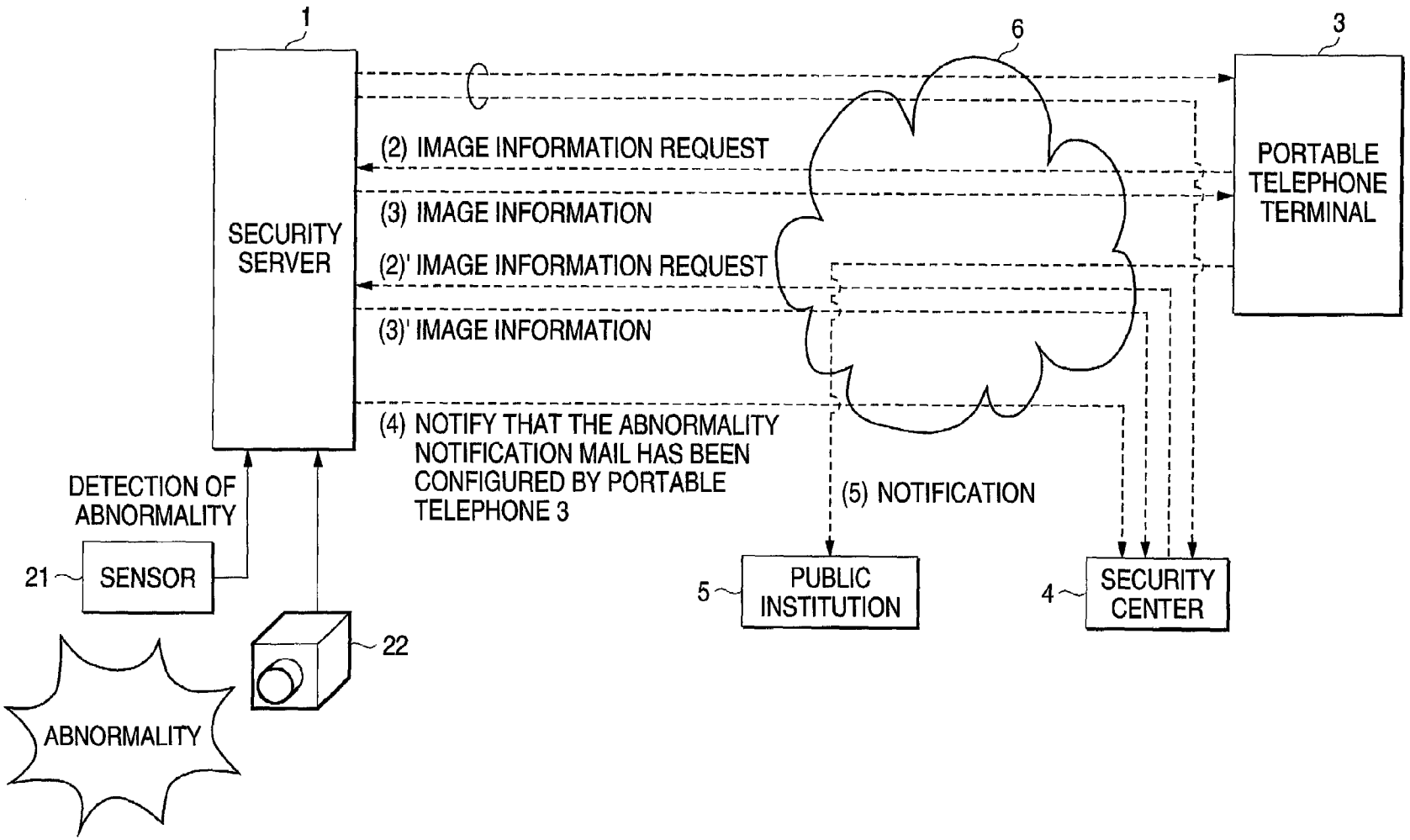
FIG. 5 shows an example of an information notifying method in the security system shown in FIG. 1.

FIG. 5 shows an example of information notification processing in case that information on abnormality is notified to the portable telephone terminal 3 and the security center 4 at the same time.

In FIG. 5, when the security server 1 receives a warning signal from the sensor 21, the security server 1 sends an abnormality notification mail that has embedded a link to the image shot by the supervision camera 22 upon occurrence of an abnormality and recorded in the image storage section 14 to the portable telephone terminal 3 and the security center 4 at the same time. Mail address of the security server 1 is also embedded in the abnormality notification mail to be sent to the portable telephone terminal 3.

In case that request of access to the image storage section 14 is made from the portable telephone terminal 3, the security server 1 grants an access to the image storage section 14. In case that request of access to the image storage section 14 is made from the security center 14, the security server 1 grants an access with restrictions that an access to a predetermined image information is inhibited.

In case that an abnormality notification mail is confirmed at the portable telephone terminal 3, the security server 1 notifies the fact to the security center 4. Whereby it is possible to prevent action not fitting the user's intention from being taken in the security center 4 in spite that the user recognizes the occurrence of an abnormality.

In the aforementioned embodiments, in case that a plurality of portable telephone terminals 3 are registered with the terminal information retaining section 18, an abnormality notification mail may be sent to all the portable telephone terminals 3 registered and determination is allowed that the abnormality notification mail is confirmed when there is an access to the image storage section 14 from at least one portable telephone terminal 3 or reception of a response mail from at least one portable telephone terminal 3.

It is more preferable that at a time when the abnormality notification mail is confirmed, the fact that the notification of abnormality information is confirmed is notified to another portable telephone terminal sent the abnormality notification mail. In this way, the abnormality notification mail may be sent to all the portable telephone terminals 3 or the abnormality notification mail may be sent to the portable telephone terminal 3 with priority that is in close proximity of the supervision place based on the location information of each portable telephone terminal 3.

It is possible to determine that the abnormality notification mail is not confirmed by the user when after resending the abnormality notification mail a predetermined times, one of the following events takes place:

(1) In spite of calling the user for a predetermined period, a response is not received.

(2) The portable telephone terminal is in a state where radio waves can not be received (power is off or the portable telephone terminal is in a place where radio waves does not reach, etc.)

(3) The line is busy.

In each of above described embodiments, a link to the image shot by the supervision camera 22 upon occurrence of an abnormality and recorded in the image storage section 14 is embedded in the body of the abnormality notification mail and the user is made access to from the portable telephone terminal 3 to the image storage section 14, whereby the image indicating the abnormal state is provided to the user. On the other hand, the image may be sent as an attached file of the abnormality notification mail.

Although, in each of embodiments, the sensor 21 is used to detect an abnormality, occurrence of an abnormality may be detected directly from the image by analyzing the image shot by the supervision camera 22.

Further more, in each of embodiments, an abnormality notification mail sent to the portable telephone terminal 3 may differ from an abnormality notification mail sent to the security center 4. For example, the abnormality notification mail sent to the portable telephone terminal 3 may have an image attached and the abnormality notification mail sent to the security center 4 may be without an image.

Next, with reference to FIGS. 2 and 7, there will be given on another example of the information notification processing in the information notifying system shown in FIG. 1.

In this embodiment, an abnormality notification from the security server 1 to the user is performed by voice. When the warning signal receiving section 21 receives a warning signal from one of the sensors 21, the warning signal receiving section 21 notifies information on the abnormality (such as a place where the abnormality has occurred, a kind of abnormality, and the like) to the voice notification control section 17. Then, the voice notification control section 17 selects an abnormality notification announcement corresponding to the information on the abnormality to call the portable telephone terminal 3 owned by the user via the communication control section 11 so that the abnormal notification announcement is notified to the user (① abnormality notification shown in FIG. 7). At this time, the voice notification control section 17 simultaneously transmits an command to the notification situation supervision section 19 so that the notification situation supervision section 19 starts to measure time by the timer 19*t* and to count the number of calling by the counter 19*c*.

When the user answers to calling the portable telephone terminal 3, the communication control section 11 transmits the abnormality notification announcement to the user. Then, the communication control section 11 transmits a command to the notification situation supervision section 19 to stop measuring time by the timer 19*t* and counting the number of calling by the counter 19*c*. Then, the information notification processing is terminated. As shown in FIG. 7, after termination of the information notification processing, the user notifies the occurrence of the abnormality to the public institutions.

Figure 7:
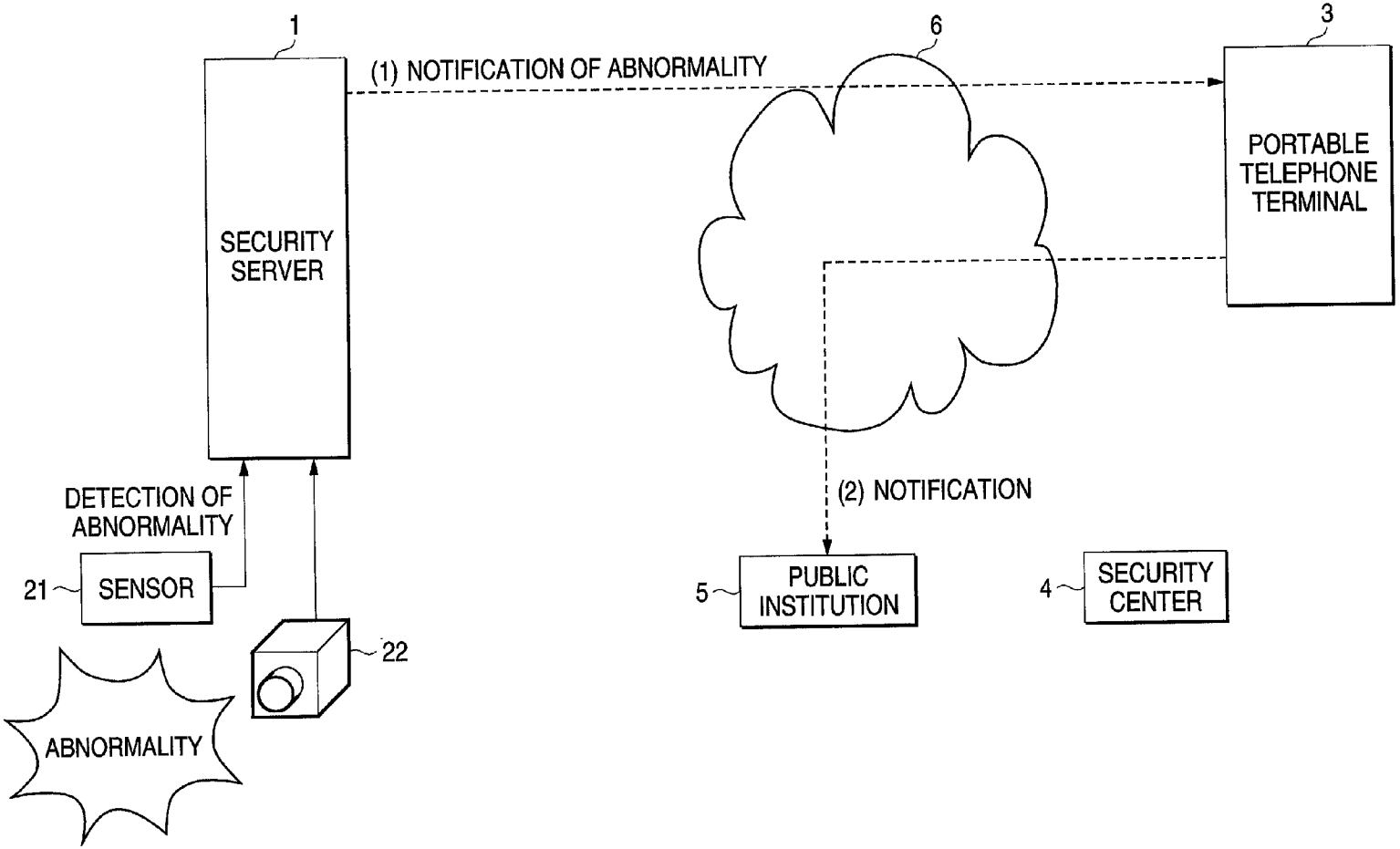
FIG. 7 shows another example of information notifying method in the security system shown in FIG. 1.

If one of the followings takes place in relation to the abnormality notification ① (calling the portable telephone terminal 3) as shown in FIG. 7:

(1) in spite of calling the user for a predetermined period, a response is not received (this may include answer phone);

(2) the portable telephone terminal is in a state where radio waves can not be received (power is off or the portable telephone terminal is in a place where radio waves does not reach, etc.); and (3) the line is busy, the communication control section 11 transmits a command to the notification situation supervision section 19 so that the counter 19*c* increments the number of calling by one.

After a predetermined period has elapsed (the predetermined period may be 0 second) from calling, the communication control section 11 calls the portable telephone terminal 3 to notify the abnormal notification announcement again.

When the number of calling counted by the counter 19*c* is equal to or larger than a predetermined value, the server 1 determines that the abnormality notification announcement can not be notified to the user, and notifies the abnormality notification mail to the security center 4 via the communication control section 11. The abnormality notification mail is prepared as well as the above described examples. The information notification processing at this time is similar to the example shown in FIG. 4 and the description therefor other than that notification from the security server 1 and the security center 4 to the portable telephone terminal 3 is performed by voice (① and ⑥ shown in FIG. 4). Thus, the detailed description is omitted.

Figure 8:
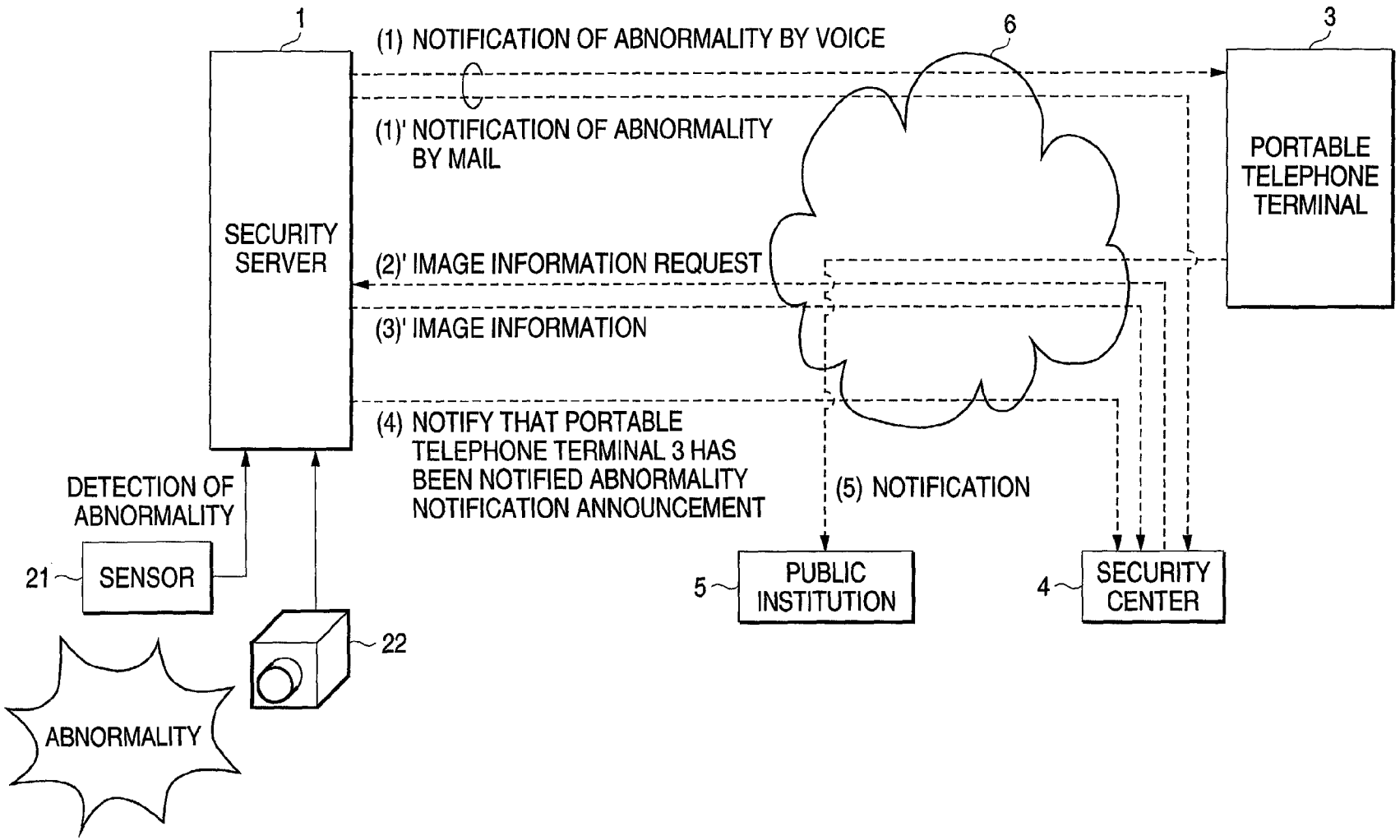
FIG. 8 shows another example of information notifying method in the security system shown in FIG. 1.

FIG. 8 is a drawing showing another example of an information notification processing in which abnormality notification is simultaneously notified to the portable telephone terminal 3 and the security center 4.

In FIG. 8, when the warning signal receiving section 12 of the security server 1 receives a warning signal from one of the sensors 21, the security server 1 prepares an abnormality notification mail that has embedded a link to the image shot by the supervision camera 22 upon occurrence of the abnormality and recorded in the image storage section 14 to transmit the mail to the security center 4 via the communication control section 11. At the same time, the voice notification control section 17 selects an abnormality notification announcement corresponding to the information on the abnormality to call the portable telephone terminal 3 owned by the user via the communication control section 11.

In case that request of access to the image storage section 14 is transmitted from the security center 14 to the security server 1, the security server 1 grants an access with restrictions that an access to a predetermined image information is inhibited.

When an abnormality notification announcement is notified to the portable telephone terminal 3, the security server 1 notifies the fact to the security center 4. Whereby it is possible to prevent action not fitting the user's intention from being taken in the security center 4 in spite that the user recognizes the occurrence of an abnormality.

In the aforementioned embodiments, in case that a plurality of portable telephone terminals 3 are registered with the terminal information retaining section 18, one of the notification by mail and the notification by voice may be registered as information notification means of each telephone terminal 3 in the terminal information retaining section 18.

As mentioned above, according to the invention, even when user having a portable terminal does not or can not confirm detection information, an abnormality, which has occurred, can be coped.

What is claimed is:

1. An information notifying method comprising:

supervising physical phenomenon of a predetermined supervision area;

when the physical phenomenon is detected by the supervising, notifying detection information indicating that the physical phenomenon is detected to each of a plurality of portable terminals while giving priority to a portable terminal closest to the supervision area based on location information of each portable terminal, the location information being detected by using location detection function of each portable terminal;

determining as to whether or not users of the portable terminals have accessed the notified detection information; and when it is determined that all of the users of the plurality of portable terminals have not accessed the detection information, notifying the detection information to an external apparatus other than the portable terminals.

2. The information notifying method according to claim 1, wherein if it is determined at a time when a predetermined period has been elapsed from the notifying of the detection information to the portable terminals, that the users have not accessed the detection information, the detection information is notified to the external apparatus other than the portable terminals.

3. The information notifying method according to claim 1, wherein the detection information is notified to the portable terminals a predetermined number of times; and when it is determined after the predetermined number times of the notifying, that the users have not accessed the detection information, the detection information is notified to the external apparatus other than the portable terminals.

4. The information notifying method according to claim 1, wherein when the detected physical phenomenon has a particular content, the detection information is notified to the external apparatus other than the portable terminals without waiting for the determining as to whether or not the users of the portable terminals have accessed the notified detection information.

5. The information notifying method according to claim 1, wherein the detection information notified to portable terminals is different from the detection information notified to the external apparatus other than the portable terminals in content.

6. The information notifying method according to claim 5, the detection information notified to the external apparatus other than the portable terminals includes information indicating as to whether or not the users have accessed the detection information notified to the portable terminals.

7. The information notifying method according to claim 1, further comprising:

receiving from the portable terminals access completion information indicating that the users have accessed the detection information notified to the portable terminals; and when the access completion information is received, determining that the users have accessed the detection information notified to the portable terminals.

8. The information notifying method according to claim 1, wherein the access completion information is an e-mail.

9. The information notifying method according to claim 1, wherein the detection information notified to the portable terminals includes at least one of still image and moving image of the detected physical phenomenon.

10. The information notifying method according to claim 1, wherein the information notified to the external apparatus other than the portable terminals is a non-image.

11. An information notifying method according to claim 1, wherein the notifying comprises notifying the detection information to the portable terminals by e-mail.

12. The information notifying method according to claim 1, wherein the notifying comprises notifying the detection information to the portable terminals by voice utilizing telephone lines.

13. The information notifying method according to claim 1, wherein the notifying comprises:

notifying the detection information to the portable terminals by e-mail; and when it is determined that the users have not accessed the detection information notified by the e-mail, notifying the detection information to the portable terminals by voice utilizing telephone lines.

14. The information notifying method according to claim 1, further comprising notifying to the portable terminals that the detection information has been notified to the external apparatus other than the portable terminals.

15. The information notifying method according to claim 1, wherein the detection information includes information used to grasp content of the physical phenomenon.

16. The information notifying method according to claim 1, wherein the determining comprises determining as to whether or not the users of the portable terminals have accessed the notified detection information on a basis of information indicating as to whether or not the portable terminals are in a state where the portable terminals can receive the detection information.

17. An information notifying apparatus comprising:

a supervision unit adapted to supervise physical phenomenon in a predetermined supervision area;

a first notification unit adapted to notify detection information indicating that the physical phenomenon has been detected to each of a plurality of portable terminals while giving priority to a portable terminal closest to the supervision area based on location information of each portable terminal, the location information detected by using location detection function of each portable terminal when the physical phenomenon has been detected by the supervision unit, a determination unit adapted to determine as to whether users of the portable terminals have accessed the notified detection information, and a second notification unit adapted to notify the detection information to an external apparatus other than the portable terminals when the determination unit determines that the users have not accessed the notified detection information.

18. The information notifying apparatus according claim 17, wherein when the determination unit determines that the users have not accessed the detection information at a time when a predetermined period has been elapsed since the first notification unit notifies the detection information to the portable terminals, the second notification unit notifies the detection information to the external apparatus other than the portable terminals.

19. The information notifying apparatus according to claim 17, wherein the first notification unit notifies the detection information to the portable terminals a predetermined number of times; and when the determination unit determines after the first notification notifies the predetermined number of times, that the users have not accessed the detection information, the second notification unit notifies the detection information to the external apparatus other than the portable terminals.

20. The information notifying apparatus according to claim 17, wherein when the detected physical phenomenon has a particular content, the second notification unit notifies the detection information to the external apparatus other than the portable terminals without waiting that the determination unit determinates as to whether or not the users of the portable terminals have accessed the notified detection information.

21. The information notifying apparatus according to claim 17, wherein the detection information notified to the portable terminals is different from the detection information notified to the external apparatus other than the portable terminals in content.

22. The information notifying apparatus according to claim 21, wherein the second notification unit notifies to the external apparatus other than the portable terminals the detection information including information indicating as to whether or not the users have accessed the detection information notified to the portable terminals.

23. The information notifying apparatus according to claim 17, wherein the determination unit receives from the portable terminals, access completion information indicating that the users have accessed the detection information notified to the portable terminals; and when the determination unit receives the access completion information, the determination unit determines that the users have accessed the detection information notified to the portable terminals.

24. The information notifying apparatus according to claim 23, wherein the access completion information is an e-mail.

25. The information notifying apparatus according to claim 17, wherein the detection information notified to the portable terminals includes at least one of still image and moving image of the detected physical phenomenon.

26. The information notifying apparatus according to claim 17, wherein the information notified to the external apparatus other than the portable terminals is a non-image.

27. The information notifying apparatus according to claim 17, wherein the first notification unit notifies the detection information to the portable terminals by e-mail.

28. The information notifying apparatus according to claim 17, wherein the first notification unit notifies the detection information to the portable terminals by voice utilizing telephone lines.

29. The information notifying apparatus according to claim 17, wherein the first notification unit notifies the detection information to the portable terminals by e-mail; and when the determination unit determines that the users have not accessed the detection information notified by the e-mail, the first notification unit notifies the detection information to the portable terminals by voice utilizing telephone lines.

30. The information notifying apparatus according to claim 17, wherein the first notification unit notifies information indicating that the detection information has been notified to the external other than the portable terminals to the portable terminals.

31. The information notifying apparatus according to claim 17, wherein the detection information includes information used to grasp content of the physical phenomenon.

32. The information notifying apparatus according to claim 17, the determination unit determines as to whether or not the users of the portable terminals have accessed the notified detection information, on a basis of information indicating as to whether or not the portable terminals are in a state where the portable terminals can receive the detection information.

* * * * *